US005588345A

United States Patent [19]

Franks et al.

[11] Patent Number: 5,588,345

[45] Date of Patent: Dec. 31, 1996

[54] FIN SHEET CONTROL APPARATUS FOR PRESS

[75] Inventors: Lawrence A. Franks, Sturgis, Mich.; Galen B. Harman, La Grange, Ind.; Herman Flint, Sturgis, Mich.

[73] Assignee: Burr Oak Tool & Gauge Company, Sturgis, Mich.

[21] Appl. No.: 156,263

[22] Filed: Nov. 22, 1993

[51] Int. Cl.[6] ..... B26D 5/22; B26D 9/00; B65H 35/06

[52] U.S. Cl. ..... 83/95; 83/100; 83/109; 83/244; 83/255; 83/257; 83/278; 83/649; 72/421; 100/95; 226/118; 242/417.1

[58] Field of Search ..... 83/95, 100, 225, 83/226, 402, 734, 109, 167, 229, 244, 255, 257, 278, 354, 357, 404, 405, 423, 649; 72/176, 404, 420, 421; 100/95, 216; 226/118; 242/117, 117.1

[56] References Cited

U.S. PATENT DOCUMENTS

| | | | |
|---|---|---|---|
| 353,190 | 11/1886 | White | 72/349 |
| 568,472 | 9/1896 | Beers | 72/421 |
| 1,012,568 | 12/1911 | Mayo et al. | 72/421 X |
| 1,136,558 | 4/1915 | Sherman | 72/405 |
| 2,690,562 | 10/1954 | Cootes | 72/420 X |
| 2,796,223 | 6/1957 | Detweiler | 242/417.1 X |
| 3,123,846 | 3/1964 | Prutton | 72/421 X |
| 3,185,400 | 5/1965 | Maxey | 242/331.3 |
| 3,284,013 | 11/1966 | Naiman et al. | 242/331.3 |
| 3,410,130 | 11/1968 | Franks et al. | 72/421 |
| 3,422,657 | 1/1969 | Grombka et al. | 72/405 |
| 3,757,619 | 9/1973 | Gianese | 83/402 |
| 4,050,642 | 9/1977 | Katsumata et al. | 242/417.1 |
| 4,052,022 | 10/1977 | Reijnhard | 242/417.1 X |
| 4,195,540 | 4/1980 | Franks | 83/95 |
| 4,269,555 | 5/1981 | Franks | 414/27 |
| 4,285,256 | 8/1981 | Franks | 83/100 |
| 4,286,486 | 9/1981 | Franks | 83/100 X |
| 4,393,682 | 7/1983 | Imanishi | 72/405 |
| 4,566,359 | 1/1986 | Miyagi et al. | 83/95 X |
| 5,109,583 | 5/1992 | Pavlov | 72/176 X |

FOREIGN PATENT DOCUMENTS

| | | | |
|---|---|---|---|
| 517366 | 6/1976 | U.S.S.R. | 72/420 |

*Primary Examiner*—Rinaldi I. Rada
*Assistant Examiner*—Clark F. Dexter
*Attorney, Agent, or Firm*—Flynn, Thiel, Boutell & Tanis, P.C.

[57] ABSTRACT

A sheet metal working apparatus having a supply mechanism adapted to supply an elongated and flat strip of sheet metal stock to an inlet of a punch press and along a longitudinal axis of the strip. An intermittently operable drive device is provided for effecting an intermittent movement of the strip of sheet metal stock relative to a punch press. A set of tools are provided on the punch press as well as a second intermittent drive device for effecting a metal working engagement of the tools with the sheet metal stock during intervals of time between the movement of the sheet metal stock to produce a continuous strip of a finished sheet metal fin stock. Guide structure on the apparatus guides the continuous finished sheet metal fin stock from an outlet of the punch press and effects a holding of the fin stock slidingly thereto until a predesignated length of fin stock has exited the punch press whereupon the fin stock becomes severed to a predefined length and an ejector mechanism forcibly moves the severed fin stock away from the guide structure toward a device for collecting a plurality of finite length segments of fin stock.

11 Claims, 4 Drawing Sheets

FIN SHEET CONTROL APPARATUS FOR PRESS

FIELD OF THE INVENTION

This invention relates to a sheet metal control apparatus for use with a heat exchanger fin making fin line or punch press and, more particularly, relates to a device for preventing the sheet metal stock from becoming wrinkled or deformed before entering the punch press and for controlling the sheet metal work product of finished fin stock following passage through the punch press so that the sheet metal fin stock will move toward a fin stack at a high rate of speed.

BACKGROUND OF THE INVENTION

Fins of the type used for attachment to heat exchanger tubes, such as those used in heating, air-conditioning and heat exchange equipment, are conventionally formed on a ribbon-type fin line apparatus. This apparatus acts on a sheet of suitable material such as sheet metal to simultaneously form a plurality of plate-like fins during each cycle of operation. In addition to severing the finished fins from the sheet stock, the apparatus also simultaneously forms several holes through each fin so that they can be positioned in surrounding relationship to appropriate heat exchanger tubes.

While this known fin line apparatus is able to produce fins at a relatively high rate, there was thought to be a maximum rate of fins that could be produced by the fin line apparatus because of constraints in handling the sheet metal stock as it enters and exits the punch press. Problems at the exit are particularly acute when the sheet metal is very thin, such as 0.002 to 0.008 inches. Further, as the sheet metal stock is gripped and moved from one position to another as the sheet metal stock passes through the punch press, faster and faster cycling times pose serious problems in assuring that the sheet metal stock is appropriately gripped and moved from position to position as the punch press systemically forms several holes through each fin. One "misfeed" of the sheet metal stock causes the work product so produced to be flawed and unusable. The maximum rate under carefully controlled constraints was about 300 cycles per minute. In an uncontrolled environment, such as out in the field, the maximum rate was about 250 cycles per minute.

Accordingly, it is an object of this invention to provide a sheet metal control apparatus which assures a consistent intermittent feeding of the sheet metal stock through the punch press at cycle times not heretofore thought possible, namely, at cycle times in excess of 300 cycles per minute, particularly in the range of 400 to 700 cycles per minute and even faster.

It is a further object of the invention to provide a sheet metal control apparatus which is capable of a high frequency intermittent driving movement of the sheet metal stock through the punch press where the sheet metal stock necessarily must be held perfectly stationary while the punch press does its work and then be flawlessly accelerated quickly so as to cause the sheet metal to move from station to station through the punch press.

It is a further object of the invention to provide a sheet metal control apparatus, as aforesaid, wherein sheet metal stock supplied to the punch press from a roll form thereof passes through a trough whereupon air blowing means solely urges the sheet metal stock to a taut condition so as to prevent violent fluttering of the sheet metal stock caused by the high frequency moving and stopping of the sheet metal stock as it is drawn into the punch press from the roll.

It is a further object of this invention to provide a sheet metal control apparatus, as aforesaid, wherein an air blowing means blows the sheet metal stock into a supporting wall surface to further keep the sheet metal stock from wrinkling and otherwise becoming deformed prior to entry into the punch press.

It is a further object of the invention to provide a sheet metal control apparatus wherein a discharge or removal device is provided adjacent the outlet from the punch press to facilitate in the rapid removal of the finished sheet metal fin stock formed by the punch press.

It is a further object of the invention to provide a sheet metal control apparatus, as aforesaid, wherein the discharge or removal device includes a strip of wire extending transversely of the longitudinal axis of the sheet metal fin stock, which strip of wire drives the finished sheet metal fin stock away from the outlet of the punch press simultaneously with the severing of the sheet metal fin stock to its finished lengths.

It is a further object of the invention to provide a sheet metal control apparatus which is reliable in operation and requires minimal maintenance.

SUMMARY OF THE INVENTION

In general, the objects and purposes of the invention are met by providing a sheet metal control apparatus having a supply mechanism adapted to supply an elongated and flat strip of sheet metal stock to an inlet of a punch press and along a longitudinal axis of the strip. An intermittently operable drive device is provided for effecting an intermittent movement of the strip of sheet metal stock relative to a punch press. A set of tools are provided on the punch press as well as a second intermittent drive device for effecting a metal working engagement of the tools with the sheet metal stock during intervals of time between the intervals of movement of the sheet metal stock to produce a continuous strip of finished sheet metal fin stock. Guide structure on the apparatus guides the continuous finished sheet metal fin stock from an outlet of the punch press and effects a holding of the fin stock slidingly thereto until a predesignated length of fin stock has exited the punch press whereupon the fin stock becomes severed to a predefined length and an ejector mechanism forcibly moves the severed fin stock away from the guide structure toward a device for collecting a plurality of finite length segments of fin stock.

BRIEF DESCRIPTION OF THE DRAWINGS

Further objects and purposes of this invention will be apparent to persons acquainted with apparatus of this general type upon reading in the following specification and inspecting the accompanying drawings, in which.

DETAILED DESCRIPTION

Figure 1:
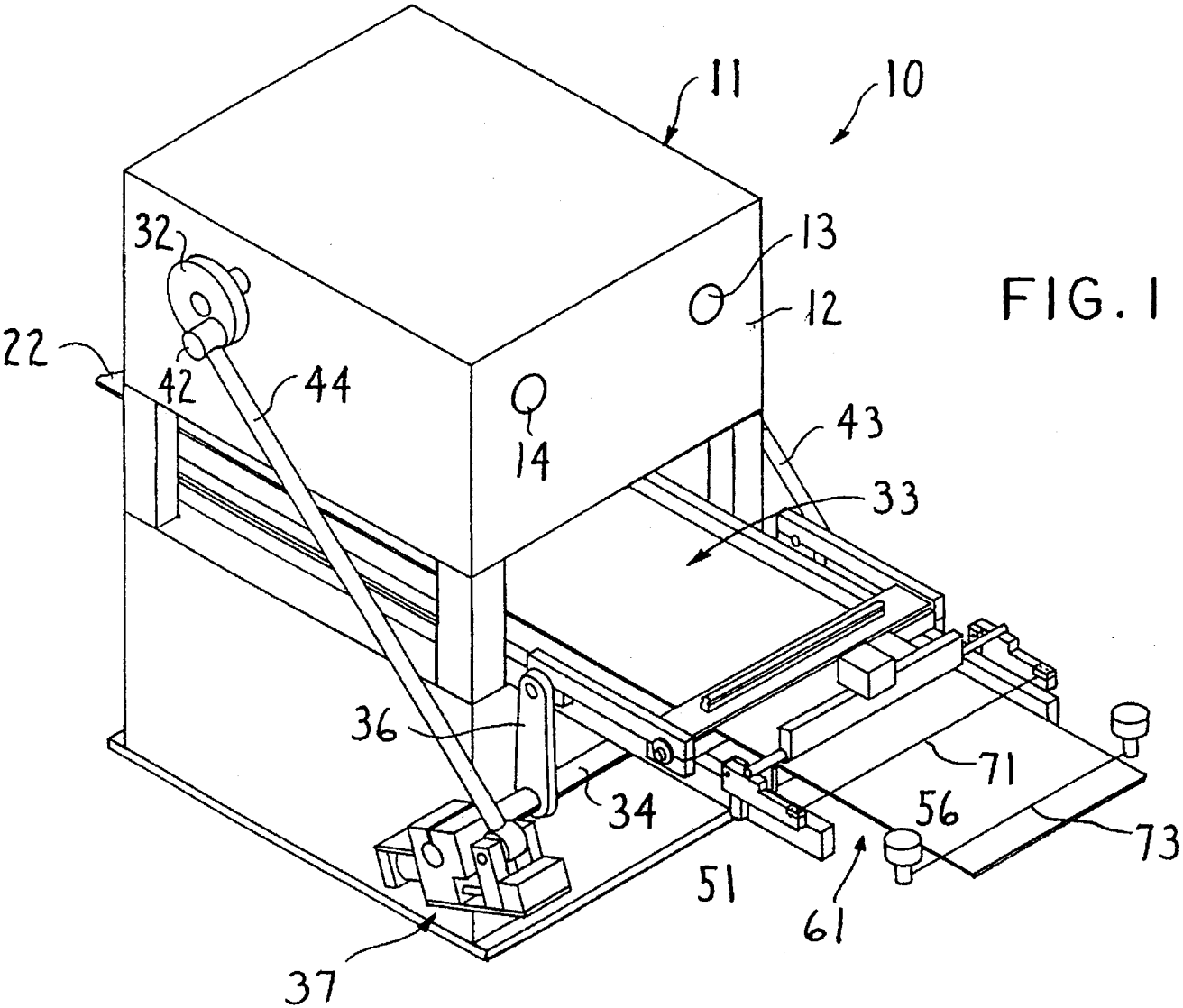
FIG. 1 is an isometric view of a fin line embodying the invention.

Certain terminology will be used in the following description for convenience in reference only and will not be limiting For example, the words "rightwardly", "leftwardly", "upwardly" and "downwardly" will refer to directions in the drawings to which reference is made. The word "forwardly" will refer to the normal direction through which the fin stock and related conveying and transporting apparatus is moved as the fin stock is moved through the punch press and away from the fin forming line. The words "inwardly" and "outwardly" will refer to directions toward and away from, respectively, the geometric center of the apparatus and designated parts thereof. Said terminology will include the words specifically mentioned, derivatives thereof and words of similar import.

Figure 4:
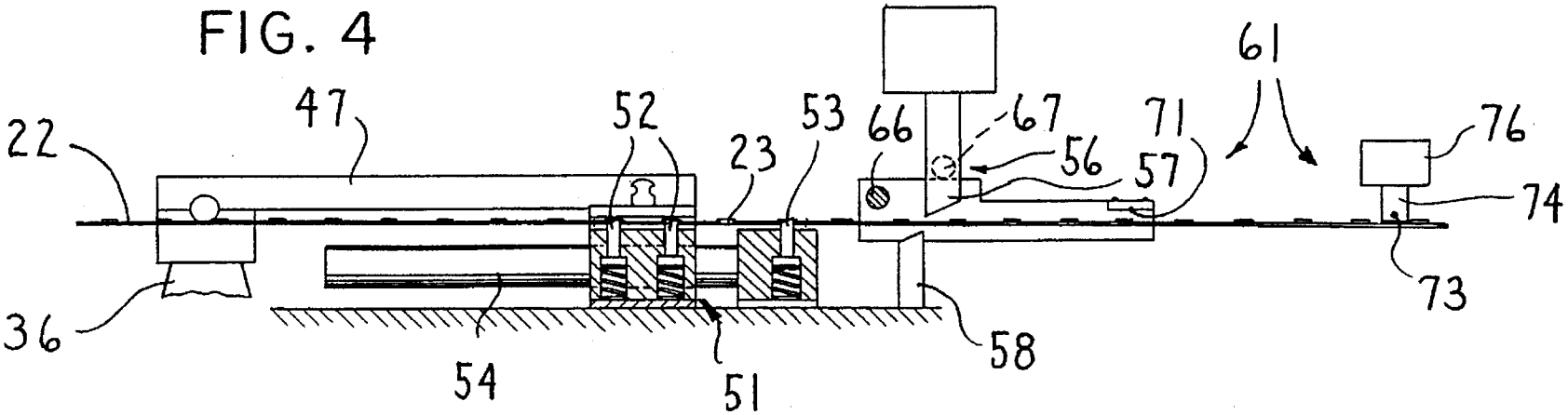
FIG. 4 illustrates an ejector device adjacent the exit from the punch press and in a first position thereof.
Figure 5:
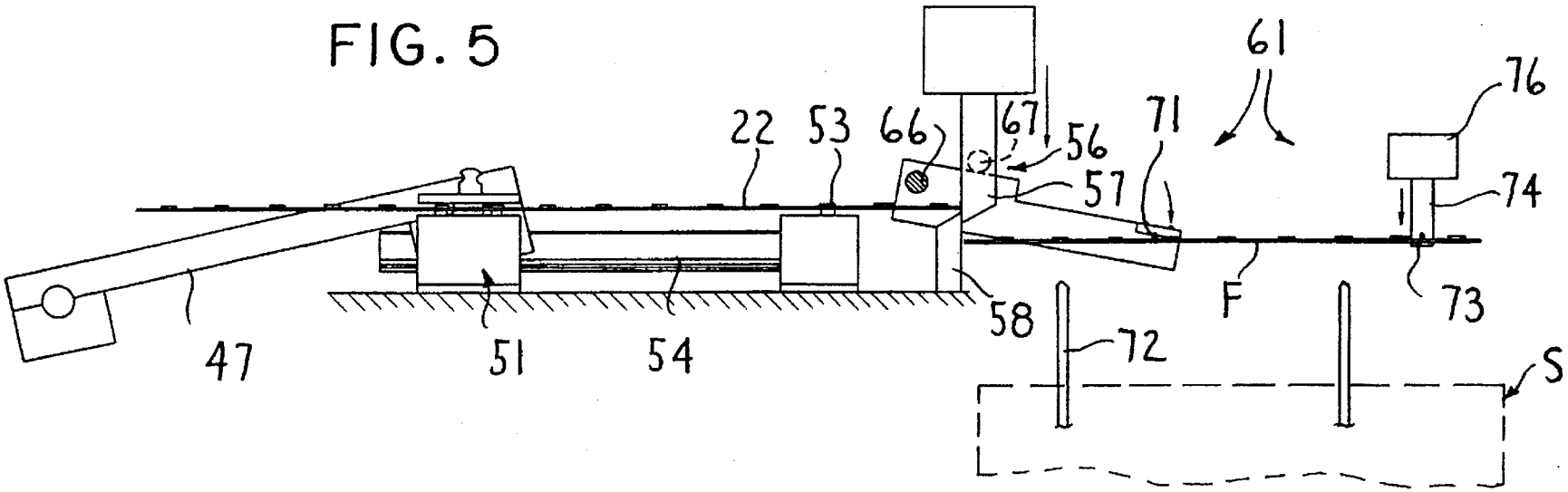
FIG. 5 is a view similar to FIG. 4 but in a second position thereof.

The drawings illustrate a sheet control apparatus 10 for feeding sheet metal stock through a fin line or punch press 11 and ejecting the fins so formed into a fin stack schematically designated at S in FIG. 5. The fin line or punch press 11 is of a conventional configuration and, therefore, further details in regard to it are deemed to be unnecessary. There is, however, one major difference between conventional punch presses (U.S. Pat. No. 4,195,540) and the punch press 11 illustrated in FIGS. 1 and 2. More specifically, and referring to FIG. 2, the punch press 11 includes a frame 12 rotatably supporting a pair of horizontally spaced shafts 13 and 14, each shaft being synchronously driven by a motor M. Each shaft 13 and 14 includes a crank arm 16 and 17, respectively, connected by an appropriate linkage 18 and 19 to a movable platen 21. The platen 21 and an anvil 24 (FIG. 3) against which the platen is moved are provided to work the sheet metal stock 22 oriented therebetween into a predesignated shape, in this particular instance, a sheet metal fin stock having several holes formed therein. The holes formed in the sheet metal stock 22 are not illustrated in FIGS. 1 and 2 but are clearly shown in FIG. 4 as at 23.

A right angle drive box 26 is connected to and driven by the shaft 13. A further right angle drive box 27 is connected to and driven by the shaft 14. The output shaft 28 of the drive box 26 is connected to a crank drive mechanism 29. Similarly, the output shaft 31 of the drive box 27 is connected to a crank device 32. As the shafts 13 and 14 are driven for rotation by the motor M, the platen 21 will be lifted and dropped onto the anvil to perform a metal working task and, simultaneously therewith, the output shafts 28 and 31 will be rotated to drive the crank mechanisms 29 and 32.

Figure 2:
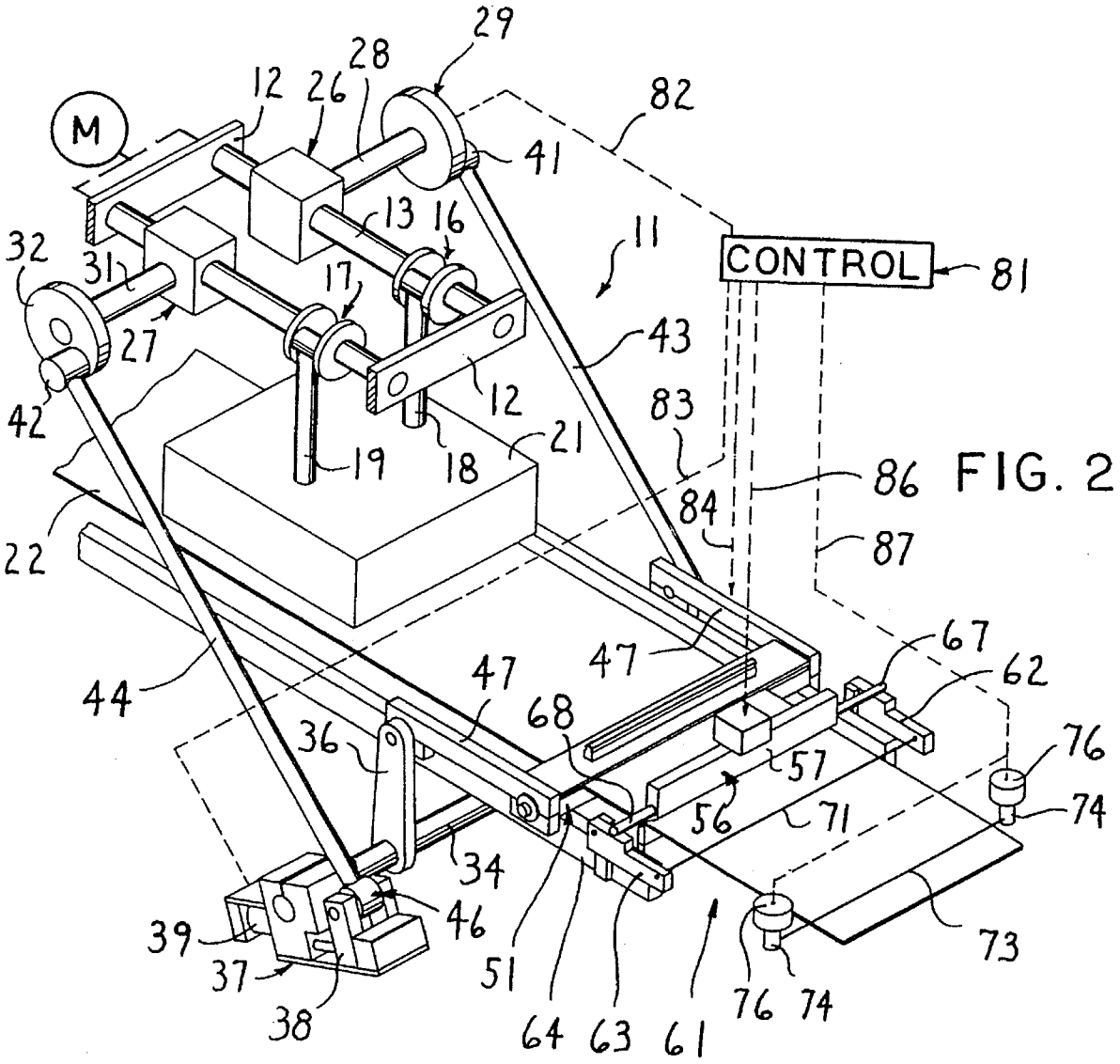
FIG. 2 is an isometric view showing further details of the fin line.
Figure 3:
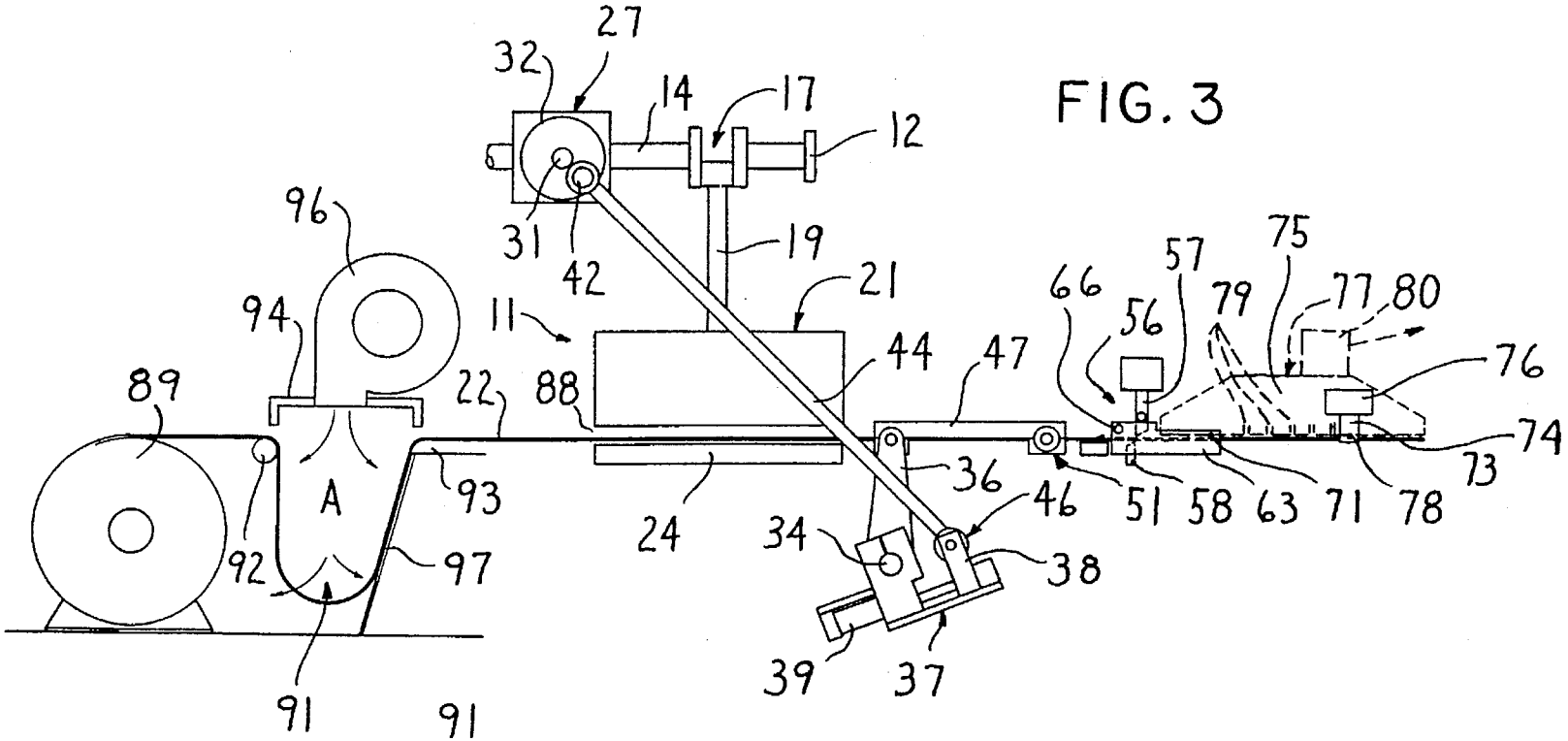
FIG. 3 is a side view of the sheet metal control apparatus embodied in the inventive fin line.

Adjacent the outlet 33 from the punch press 11 there is provided a driven shaft 34 extending laterally of the longitudinal axis of the sheet metal stock 22 as well as beneath same as shown in FIG. 1. A pair of crank arms 36 (only one of which is shown in FIGS. 1 and 2) are fixedly secured to the driven shaft 34 and on opposite lateral sides of the sheet metal stock 22 and are adapted to move with the shaft 34 as it is rotated or rocked back and forth about its longitudinal axis. A conventional feed progression changing device 37 (only one of which is shown in FIGS. 1–3) is secured to each end of the shaft 34. The feed progression changers 37 are conventional and are illustrated in U.S. Pat. No. 3,410,130 and referenced thereto is to be incorporated herein. Generally, each of the two feed progression changers 37 include a reciprocal carriage 38 driven for reciprocation by a pneumatic or hydraulic cylinder 39. Each of the crank pins 41 and 42 on the crank mechanisms 29 and 32, respectively, are connected through elongated drive shafts 43 and 44 to an appropriate connection 46 causing the respective drive shaft 43 and 44 to become pivotally connected to the carriage 38. A movement of the carriage 38 between its two limit positions controlled by the cylinder 39 will cause the point of connection of the respective drive shafts 43 and 44 to the carriage 38 to shift, thereby altering the length of the stroke of the crank arms 36 fixedly secured to the shaft 34 as is explained in more detail in the aforementioned U.S. Pat. No. 3,410,130. Further, and as a result of the dual drive provided by the drive shafts 43 and 44 as well as the dual drive provided by the crank arms 36 on opposite lateral sides of the sheet metal stock 22, a reciprocal drive plate 51 is driven from both ends thereof by the crank arms 36 and additional linkage members 47 back and forth along the longitudinal axis of the sheet metal stock 22 to cause projecting retractable drive fingers 52 to be received in apertures 23 in the sheet metal stock. This drive arrangement causes the sheet metal stock to be horizontally fed through the punch press 11 in an intermittent step-like manner. A set of stop fingers 53 which are also retractable in a conventional manner are provided to periodically hold the sheet metal stock 53 in a fixed position by engagement thereof into a selected one of the holes 23 formed in the sheet metal stock as illustrated in FIG. 4. In this particular embodiment, a guide rail 54 is provided to guide the reciprocal drive plate 51 during its back and forth travelling movement to assure that the drive fingers 52 will engage a set of holes 23 formed in the sheet metal stock at its rearmost position illustrated in FIG. 5.

The finished sheet metal work product exits the punch press as at 33 through a cut off mechanism 56. The cut off mechanism 56 includes a movable cutter blade 57 and a fixed cutter blade 58.

An ejector device 61 is located downstream (to the right) of the cut off mechanism 56 and includes a pair of laterally spaced pivotal bracket members 62 and 63 pivotally mounted as at 66 to a frame component 64 provided on the frame 12 of the punch press 11. A pair of rods 67 and 68 (FIG. 2) extend from opposite ends of the movable cutter blade 57 and engage a top surface of the bracket members 62 and 63, respectively, such that when the movable cutter blade 57 is moved from the position illustrated in FIG. 4 to a position illustrated in FIG. 5 about the pivot axis 66, the rods 67 and 68 will forcibly drive the bracket members 62 and 63 about the pivotal axle 66 as illustrated in FIGS. 4 and 5.

Opposite ends of a strand of wire 71 are secured by any conventional type of means to each of the bracket members 62 and 63. The strand of wire 71 extends over the top surface of the finished sheet metal fin stock as illustrated in FIGS. 2, 4 and 5. As a result, and as the movable cutter blade 57 moves from the FIG. 4 position to the FIG. 5 position, the strand of wire 71 will move into engagement with the top surface of the sheet metal work product to forcibly drive the finished sheet metal fin stock downwardly and onto at least a pair of stacking pins 72 to form a stack of fins S. Since the length of finished sheet metal fin stock may be sometimes long, an additional strand of wire 73 car be provided with opposite ends thereof being fixedly connected to a reciprocal pin 74 on each of a pair of solenoid actuator servo mechanisms 76.

A conventional finished sheet metal fin stock supporting structure 77, conventionally referred to as a suction head 77, is known from U.S. Pat. No. 4,195,540 and reference thereto is to be incorporated herein. The suction head 77 guides in a straight line the sheet metal fin stock exiting the press as disclosed in the above U.S. Patent. The suction head includes a lower horizontal support plate, schematically shown at 78 in FIG. 3, which has several rows of small apertures or holes 79 therethrough. The apertures are positioned to extend substantially along the lengthwise edges of the finished sheet metal fin stock which is positioned directly beneath the plate 78. These apertures communicate with an interior suction chamber 75, which in turn communicates with a suction fan 80. This arrangement creates a suction within the chamber so that air flows upwardly through the apertures, thereby holding the finished sheet metal fin stock against the undersurface of the plate 78. After the finished sheet metal fin stock has been fed outwardly of the outlet from the punch press beneath the plate 78, the cut off device 56 is actuated in a conventional manner to sever the free ends of the finished sheet metal fin stock from the continuous sheet metal strip which extends through the punch press 11, which severed sheet metal fin stock now form completed fins, which fins are held in side-by-side relationship adjacent the undersurface of the plate 78. The aforementioned wires 71 and 73 are synchronously moved to forcibly urge the finished fins away from the effect of the suction force drawing the finished fins into engagement with the undersurface of the plate 78. Since the diameter of the wires 71 and 73 is in the range of about 0.030 inches, the rapid fluttering movement of the wire will not adversely effect the movement of air into the apertures in the plate 78. As a result, the flow of air in and around the suction head will not be appreciably disturbed by the rapid movement of the wires 71 and 73 to enable the finished fins to drop down on to the stacking pins 72 to form the aforesaid fin stack S. In some instances, it may be preferable to exhaust the suction head to the atmosphere to break the suction effect holding the finished fins to the plate 78 at the same time that the wires 71 and 73 knock the finished fins away therefrom.

An appropriate control device 81 (FIG. 2) is provided to synchronize the drive of the punch press with the drive of the sheet metal stock 22 as well as the drive of the cutting mechanism 56 and the ejector mechanism 61. For example, the control 81 includes a circuit for detecting the number of rotations of the output shaft 28 and an appropriate counting signal is sent to the control through to the control line 82. Appropriate control signals from the control 81 are sent through the control lines 83 and 84 to the cylinders 39 on the feed progression changers 37 to control the stroke provided to the crank arms 36. For example, if each stroke of the crank arm is to effect a movement of the sheet metal stock step-by-step through a distance comparable to the spacing between four holes punched into the sheet metal stock, no signals will need to be sent through the control lines 83 and 84. However, if, for some reason, the number of holes in the sheet metal stock is to vary from the normal four holes, an appropriate signal will be sent to the cylinders 39 and each of the feed progression changers 37 to shift the position of the carriage 38 to thereby alter the stroke of the crank arms 36. Further, and after the control 81 has counted a certain number of rotations of the shaft 28, an appropriate signal will be sent to the control line 86 to the cutting mechanism 56 to cause the movable cutting blade 57 to be driven downwardly from the FIG. 4 position to the FIG. 5 position to effect a severing of the finished sheet metal fin stock from the continuous strip to thereby form a finished fin F. Simultaneously therewith, the pair of bracket members 62 and 63 will be pivoted to drive the wire 71 into engagement with the top surface of the finished fin F. Simultaneously therewith, the control 81 will send a signal through the control line 87 to the pair of servo mechanisms 76 to cause the pins 74 thereof to drive the wire 73 into engagement with the top surface of the finished fin F to break the suction force holding the finished fin F to the underside of the suction head 77 as aforesaid.

Figure 3A:
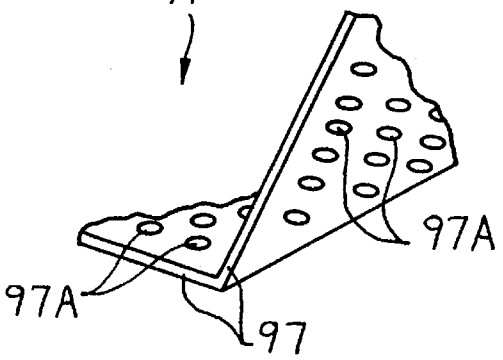
FIG. 3A is an enlarged isometric view of a fragment of FIG. 3.

The aforementioned intermittent driving movement of the sheet metal stock 22 can be accelerated to speeds of 400 to 700 strokes per minute without generating any misfeeding of the sheet metal stock 22. This result was surprising because hereto the maximum number of strokes was thought to be less than about 320 strokes per minute. The primary explanation for this phenomenon is the reciprocal driving of the shaft 34 from both ends. The jerking movement of the sheet metal stock 22 as it enters the inlet 88 to the punch press 11 causes considerable tension forces to be applied to the sheet metal stock as it is pulled from the supply roll 89. When the punch press 11 is driven at high rates of speed, the sheet metal stock oriented between the roll 89 and the inlet 88 to the punch press 11 is in need of a control which will allow the sheet metal stock to be started and stopped at rapid intervals and without applying an appreciable drag force which may cause the sheet metal stock to tear at the point where the drive fingers 52 grip the holes 23 and as the sheet metal is accelerated from a fully stationary condition to a moving condition to introduce sheet metal stock into the inlet 88 of the punch press 11. In this particular instance, a trough is formed in the sheet metal stock 22 by causing the sheet metal stock to move down over a generally transversely extending horizontal guide rail 92 down into a trough 91 of the apparatus, and up over a further generally transversely extending horizontal guide structure 93 as the sheet metal stock moves out of the trough toward the inlet 88 to the punch press 11. An auxiliary frame component 94 is oriented above the trough 91 and supports a blower fan 96 directing a blast of air from the outlet port in the direction of the arrows A in FIG. 3 down into the trough 91 to urge the sheet metal stock 22 toward the floor. In this particular embodiment, and as shown in FIG. 3A, a perforated sheet of sheet metal 97 having a plurality of holes 97A therein forms a bottom wall and a sidewall of the trough 91 and against which the sheet metal stock 22 is urged by the blast of air A. The mere frictional force of the sheet metal stock 22 against the perforated sheet metal 97 will be sufficient to keep the sheet metal stock 22 from buckling and becoming wrinkled when it moves from a rapid moving condition to a fully stopped position. Yet, and on the other hand, the blast of air A is sufficiently yieldable to sudden starting movements of the sheet metal stock 22 to allow the depth of the trough of the sheet metal stock to quickly shrink until the blast of air is able to push more of the sheet metal stock down into the trough thereby drawing more sheet metal stock from the roll supply 89. As a result of this sheet metal control apparatus oriented adjacent the inlet to the punch press 11, intermittent speeds of 400 to 700 strokes per minute have been successfully achieved without causing a buckling and a wrinkling or other deformation of the sheet metal stock prior to its entry into the inlet 88 of the punch press 11. Further, a driving of both lateral ends of the drive shaft 34 causes the reciprocal drive plate 51 to also be driven from both lateral sides thereof and thereby be accurately controlled as it is reciprocated toward and away from the outlet 33 to the punch press 11 to thereby cause the drive fingers 52 to be accurately aligned with the holes 23 formed in the sheet metal stock to cause the drive fingers 52 to appropriately engage the sheet metal stock to effect its movement lengthwise through the punch press 11.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A sheet metal working apparatus, comprising:

a sheet metal working press;

sheet metal supply means adapted to supply an elongated and flat strip of sheet metal stock to an inlet of said press and along a path of movement;

intermittent first drive means for effecting an intermittent movement of said strip of sheet metal stock relative to said press along the path of movement;

intermittent second drive means for effecting a metal working engagement of a press tool means on said press with said sheet metal stock during intervals of time between said intermittent movement of said sheet metal stock to produce a continuous strip of finished sheet metal fin stock;

guide means for guiding said continuous strip of finished sheet metal fin stock in a straight line from an outlet of said press, said guide means including means defining a downwardly facing surface having a plurality of openings therein which are connected to a chamber in said means defining said downwardly facing surface, said guide means further including means for drawing air into said plurality of openings and said chamber to cause said continuous strip of finished sheet metal fin stock to be drawn into sliding engagement with said downwardly facing surface and be supported in said straight line, as said continuous strip of finished sheet metal fin stock exits said outlet, by a negative pressure in a space between said continuous strip of finished sheet metal fin stock and said downwardly facing surface;

sheet metal cutting means for cutting said continuous strip of finished sheet metal fin stock into a finished fin and along a line transversely of the path of movement of said strip of sheet metal stock, said finished fin being retained by said negative pressure in engagement with said surface;

ejecting means for striking said finished fins and forcibly moving said finished fins away from said downwardly facing surface to break said negative pressure so as to allow said finished fins to move freely perpendicularly away from said downwardly facing surface, said ejecting means including at least one strip of wire extending transversely of the path of movement, said ejecting means further including a pair of moveable supports straddling the path of movement and being movable in a direction generally toward and away from the path of movement, said wire being secured to each pair of said movable supports and movable with said movable supports to effect said striking by said wire of said finished fins to forcibly move said finished fins away from said downwardly facing surface; and collecting means for facilitating a collecting of a plurality of said finished fins in a stack.

2. The sheet metal working apparatus according to claim 1, wherein said wire has a diameter of about 0.030 inches, and wherein said sheet metal stock has a thickness in the range of 0.0035 to 0.0040 inches.

3. A sheet metal working apparatus, comprising:

a sheet metal working press;

sheet metal supply means adapted to supply an elongated and flat strip of sheet metal stock to an inlet of said press and along a path of movement;

intermittent first drive means for effecting an intermittent movement of said strip of sheet metal stock relative to said press along the path of movement;

intermittent second drive means for effecting a metal working engagement of a press tool means on said press with said strip of sheet metal stock during intervals of time between said intermittent movement of said strip of sheet metal stock to produce a continuous strip of finished sheet metal fin stock;

guide means for guiding said continuous strip of finished sheet metal fin stock in a straight line from an outlet of said press, said guide means including means defining a downwardly facing surface having a plurality of openings therein which are connected to a chamber in said means defining said surface, said guide means further including means for drawing air into said openings and said chamber to cause said continuous strip of finished sheet metal fin stock to be drawn into sliding engagement with said downwardly facing surface and be supported in said straight line, as said continuous strip of finished sheet metal fin stock exits said outlet, by a negative pressure in a space between said continuous strip of finished sheet metal fin stock and said surface;

sheet metal cutting means for cutting said continuous strip of finished sheet metal fin stock into a finished fin and along a line transversely of the path of movement of said strip of sheet metal, said finished fin being retained by said negative pressure in engagement with said surface;

ejecting means for striking said finished fins and forcibly moving said finished fins away from said downwardly facing surface to break said negative pressure so as to allow said finished fins to move freely perpendicularly away from said surface; and collecting means for facilitating a collecting of a plurality of finished fins in a stack;

wherein said sheet metal supply means includes a roll of sheet metal stock and support means for rotatably supporting said roll, and further includes between said roll and said inlet, a means for forming and maintaining said strip of sheet metal stock into a generally upwardly opening, laterally extending, trough so that when said strip of sheet metal stock is moved into said inlet caused by said intermittent first drive means, said strip of sheet metal stock will be drawn from said trough rather than directly from said roll, wherein said means for forming and maintaining said strip of sheet metal stock into said trough includes wall means defining at least one upstanding wall surface oriented along a side of said trough adjacent said inlet and an air blowing means having an air outlet oriented above said trough and aiming air exiting said air outlet into said trough and at a sufficient volume to urge said strip of sheet metal stock into frictional sliding engagement with said upstanding wall surface so as to cause said strip of sheet metal stock to be kept under tension and free of wrinkling as said strip of sheet metal stock is intermittently pulled into said inlet by said intermittent first drive means.

4. The sheet metal working apparatus according to claim 3, wherein said upstanding wall surface has a plurality of holes therethrough so that air between said sheet metal stock and said upstanding wall surface can escape thruogh said plurality of holes.

5. The sheet metal working apparatus according to claim 4, wherein said wall means further includes a further pervious wall section extending from a lower edge of said upstanding wall surface on a side thereof remote from said inlet to form a further wall against which said sheet metal stock is blown to thereby limit a depth of said trough.

6. The sheet metal working apparatus according to claim 3, wherein said sheet metal stock has a thickness that is in the range of 0.0035 to 0.0040 inches.

7. A sheet metal working apparatus, comprising:

a sheet metal working press;

sheet metal supply means adapted to supply an elongated and flat strip of sheet metal stock to an inlet of said press and along a path of movement;

intermittent first drive means for effecting an intermittent movement of said strip of sheet metal stock relative to said press;

intermittent second drive means for effecting a metal working engagement of a tool means on said press with said strip of sheet metal stock during intervals of time between said intermittent movement of said strip of sheet metal stock to produce a continuous strip of finished sheet metal fin stock; and wherein said sheet metal supply means includes a roll of sheet metal stock and support means for rotatably supporting said roll, and further includes, between said roll and said inlet, a means for forming and maintaining said strip of sheet metal stock into a generally upwardly opening, laterally extending, trough so that when said strip of sheet metal stock is moved into said inlet caused by said intermittent first drive means, said strip of sheet metal stock will be drawn from said trough rather than directly from said roll of sheet metal stock, said means for forming and maintaining said strip of sheet metal stock into said trough including wall means defining at least one upstanding wall surface oriented along a side of said trough adjacent said inlet and an air blowing means having an air outlet oriented above said trough and aiming air exiting said air outlet into said trough and at a sufficient volume to urge said strip of sheet metal stock into frictional sliding engagement with said upstanding wall surface so as to cause said strip of sheet metal stock to be kept under tension and free of wrinkling as said sheet metal stock is pulled into said inlet by said intermittent first drive means.

8. The sheet metal working apparatus according to claim 7, wherein said upstanding wall surface has a plurality of holes therethrough so that air between said sheet metal stock and said upstanding wall surface can escape through said plurality of holes.

9. The sheet metal working apparatus according to claim 8, wherein said wall means further includes a further pervious wall section extending from a lower edge of said upstanding wall surface on a side thereof remote from said inlet to form a further wall against which said sheet metal stock is blown to thereby limit a depth of said trough.

10. The sheet metal working apparatus according to claim 9, wherein said sheet metal stock has a thickness that is in the range of 0.0035 to 0.0040 inches.

11. A sheet metal working apparatus, comprising:

a sheet metal working press;

sheet metal supply means adapted to supply an elongated and flat strip of sheet metal stock to an inlet of said press and along a path of movement;

intermittent first drive means for effecting an intermittent movement of said strip of sheet metal stock relative to said press along the path of movement, said intermittent first drive means including a drive shaft of finite length adjacent an outlet of said press and extending transversely of the path of movement, said drive shaft being supported for a back and forth rotating motion;

a rotatable output shaft means on said press;

a reciprocating drive connection means for drivingly connecting said rotatable output shaft means to both ends of said drive shaft to cause said ends to be driven back and forth at precisely the same rate; and said intermittent first drive means further including a guide rail extending parallel to the path of movement for said strip of sheet metal stock and a sheet metal gripping means mounted on said guide rail for back and forth movement and extending transversely across the path of movement for said strip of sheet metal stock, said sheet metal gripping means effecting a release of its grip on said sheet metal stock in one direction of movement and drivingly gripping said sheet metal stock in an opposite direction, and connecting means for connecting each lateral side of said sheet metal gripping means to said respective opposite ends of said transversely extending drive shaft so as to assure that both lateral sides of said sheet metal gripping means are driven back and forth at precisely the same rate.

* * * * *